US005692329A

United States Patent [19]

Tang

[11] Patent Number: 5,692,329

[45] Date of Patent: Dec. 2, 1997

[54] LEVITATING PICTURE FRAME

[76] Inventor: Sing Hai Tang, 4 Fernhill Crescent, Singapore 1025, Singapore

[21] Appl. No.: 560,444

[22] Filed: Nov. 17, 1995

[51] Int. Cl.[6] ..... G09F 19/02

[52] U.S. Cl. ..... 40/424; 40/711

[58] Field of Search ..... 40/711, 426, 720, 40/538; 446/129, 133

[56] References Cited

U.S. PATENT DOCUMENTS

| | | | |
|---|---|---|---|
| 2,220,049 | 10/1940 | Dunmore | 40/426 |
| 2,377,175 | 5/1945 | Peer | 40/426 X |
| 3,139,865 | 7/1964 | Aimes | 40/427 X |
| 3,196,566 | 7/1965 | Littlefield | 40/538 X |
| 3,874,102 | 4/1975 | Sheppard | 40/426 |
| 4,233,777 | 11/1980 | Inoue | 40/426 X |
| 4,901,456 | 2/1990 | Cotutsca | 40/711 |
| 5,188,555 | 2/1993 | Zbegnor | 446/133 |
| 5,298,875 | 3/1994 | Laibowitz | 40/426 X |

*Primary Examiner*—Joanne Silbermann
*Attorney, Agent, or Firm*—Morgan & Finnegan, L.L.P.

[57] ABSTRACT

A new design of picture frame that levitates and rotates in the air without mechanical support is described. A permanent magnet (5) is mounted on the top of the picture frame (2) such that the center of the magnet coincides with a vertical axis through the center of gravity of the picture frame. The picture frame is positioned below and within an outer fixed framework (1). An electro-magnet (3) is mounted on the top of the fixed framework such that the center of the electro-magnet (3) coincides with the said vertical axis. An additional set of electro-magnet on the fixed framework (8, 10) and permanent magnet on the picture frame (6, 10) are employed for nearly periodic rotation of the picture frame.

6 Claims, 2 Drawing Sheets

LEVITATING PICTURE FRAME

FIELD OF THE INVENTION

This invention relates to new picture frame design, and more particularly to a picture frame that rotates and levitates in the air by means of electronic and magnetic controls.

BACKGROUND OF THE INVENTION

The art of picture framing has been traditionally a combination of artistic design and craftsmanship. For centuries, picture frames have always been placed on table-tops or hung on walls. Mechanical supports of one form or another are necessary for propping up the frames. A picture frame that rotates while levitating in the air without mechanical support is a totally new concept.

BRIEF SUMMARY OF THE INVENTION

A new type of picture frame that rotates while levitating in the air without mechanical support has been constructed using electronic servo-control technology and powerful magnets.

A permanent magnet is mounted on the top of a picture frame such that the center of the magnet coincides with a vertical axis through the center of gravity of the picture frame. The picture frame is positioned within an outer fixed framework. An electro-magnet is mounted on the top of the fixed framework such that the center of the electro-magnet coincides with the vertical axis. To have nearly periodic rotation of the picture frame, an additional set of electro-magnet on the outer fixed frame and an additional permanent magnet on the picture frame may be employed.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
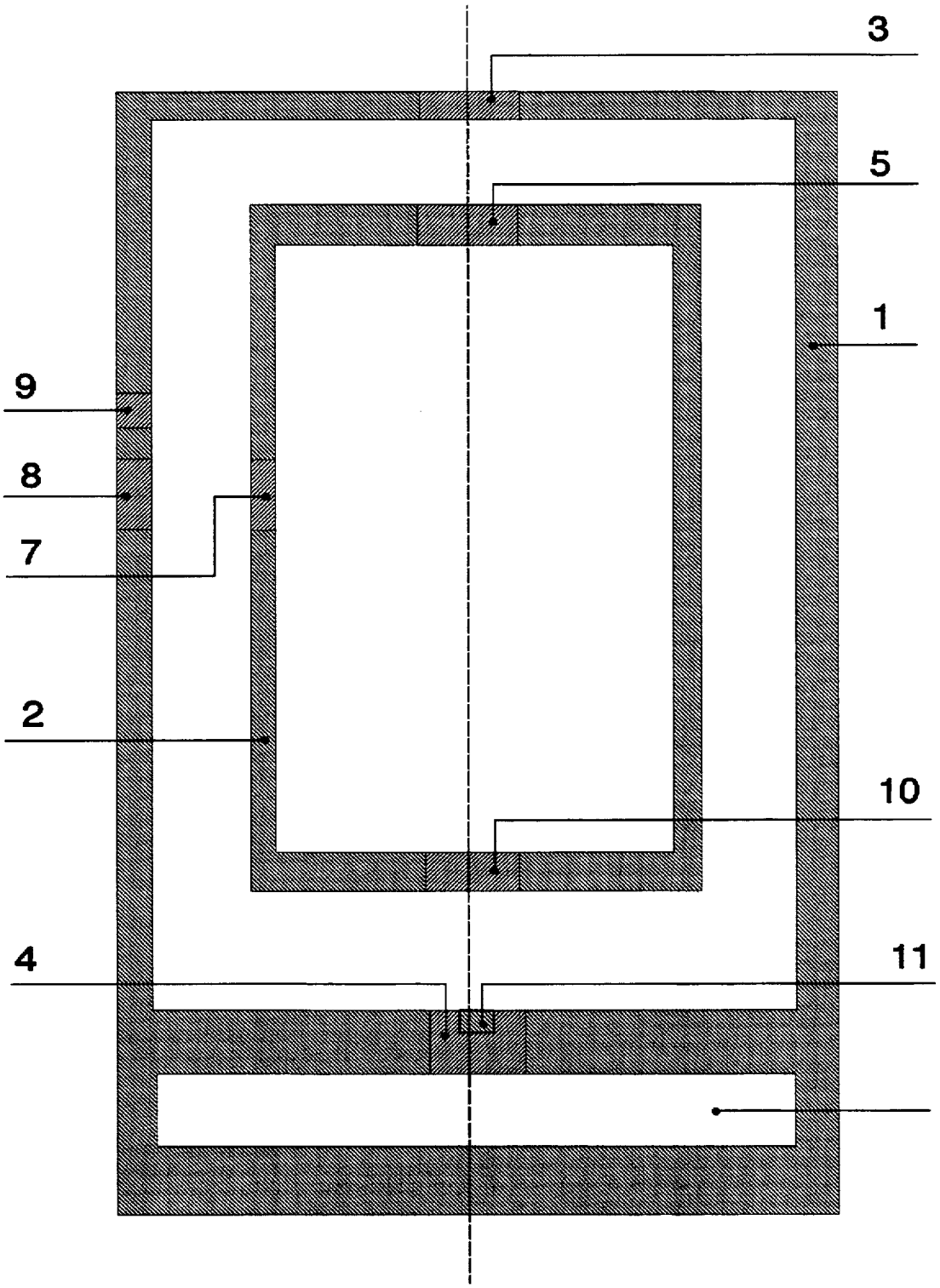
FIG. 1 is a schematic diagram of the levitating picture frame.
Figure 2:
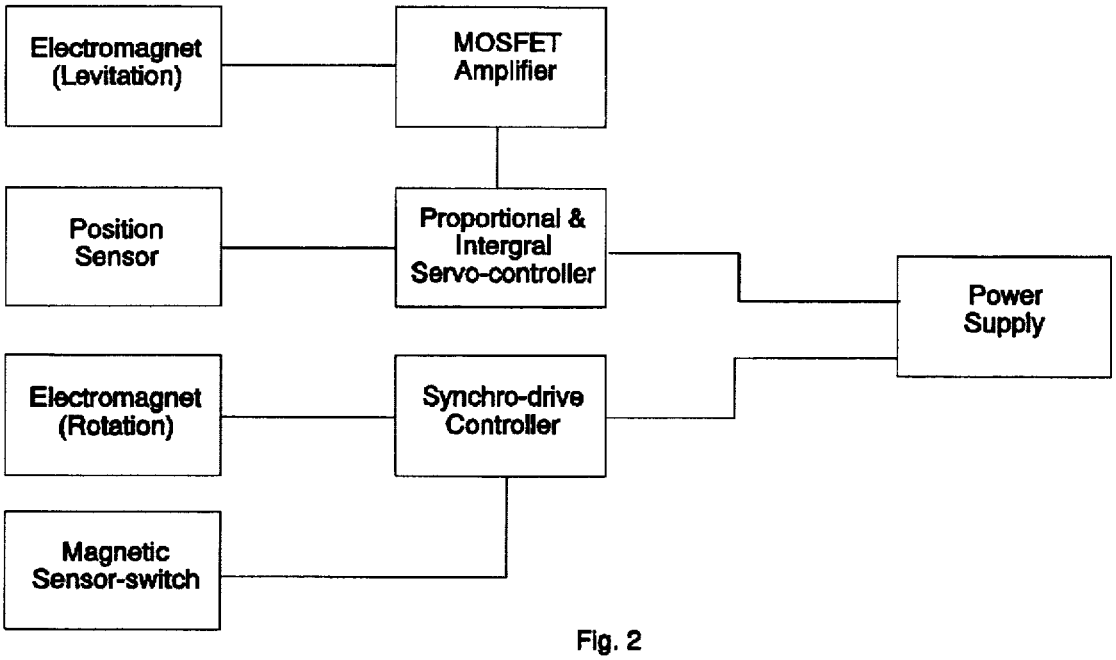
FIG 2 is a block diagram of the electronics.

FIG. 1 illustrates the levitating picture frame which comprises an outer fixed frame (1) wherein the picture frame (2) levitates and rotates. A permanent magnet (5) is mounted on the top part of the picture frame (2) such that the center of the permanent magnet (5) coincides with a vertical axis through the center of gravity of the picture frame (2). An electro-magnet (3) is mounted on the top part of the outer fixed frame (1) such that its center also coincides with the vertical axis.

A position sensor (4) consisting of a coil and a permanent magnet at the bottom of the outer fixed frame (1) detects the levitating position of the picture frame (2) and provides an electrical feedback to a proportional and integral servo-controller that regulates a MOSFET amplifier supplying current to the electro-magnet (3). The center of the position sensor (4) also coincides with the vertical axis. A permanent magnet (6) is mounted in the bottom part of the picture frame (2) such that its center coincides with the vertical axis to trigger the position sensor (4). The permanent magnet (10) inside the position sensor (4) improves the stability of levitation. The gap between the electro-magnet (3) and the permanent magnet (5) on the top of the picture frame is a stable but adjustable value between 0.5 cm and 2.5 cm.

The picture frame (2) may also be made to rotate nearly periodically about the vertical axis through the center of gravity. For this purpose, a permanent magnet (7) is mounted on a side of the picture frame (2), shown in FIG. 1 as a lateral side. An electro-magnet (8) and a magnetic sensor-switch (9) are mounted on the outer fixed frame (1) at a position opposing the side mounted permanent magnet (7). The magnetic sensor-switch (9) detects the rotational movement of the picture frame and activates the electro-magnet (8) with a repulsive impulse that kicks on the side mounted permanent magnet (7). Depending on the shape of the picture frame (2) there may be more than one position opposing the electro-magnet (8) and sensor switch. Hence, a plurality of permanent magnets may be similarly installed on the picture frame (2). The direction and rate of rotation may be adjusted for visual presentation between 5 sec per revolution and 30 sec per revolution by known electronics control mechanisms (11), such as a synchro-drive controller.

The picture frame (2) may be also be used as a multi-purpose display frame. The photograph or print may be replaced by other small objects. The shape of the picture frame may be adjusted to hold such small objects, otherwise the construction of the multi-purpose display frame remains identical to the picture frame (2).

What is claimed is:

1. A display device consisting of an outer fixed frame with opposed and spaced sides;

a picture frame freely levitating and rotating within the spaced sides of the outer fixed frame;

a first permanent magnet mounted on the top part of the picture frame and a second permanent magnet mounted at the bottom part of the picture frame such that the centers of the two mounted permanent magnet coincide with a vertical axis through the center of gravity of the picture frame;

a third permanent magnet mounted at the bottom part of the fixed outer frame such that the center of the third permanent magnet coincides with said vertical axis and with the polarity of the third permanent magnet being such that a downward pulling force is exerted on the picture frame;

an electro-magnet mounted on the top part of the outer fixed frame such that its center also coincides with said vertical axis with the magnetic polarity of the electro-magnet such that an upward lifting force is exerted on the picture frame; and a levitation position sensor mounted in the bottom part of the outer fixed frame with its center coinciding with said vertical axis and a permanent magnet mounted at the bottom of the picture frame with the center of the bottom mounted permanent magnet coinciding with said vertical axis to trigger the levitation position sensor.

2. The display device described in claim 1, wherein the gap between the top mounted electro-magnet mounted of the outer fixed frame and the top mounted permanent magnet of the picture is between 0.5 cm and 2.5 cm.

3. A display device with a levitating and rotating picture frame consisting of:

an outer fixed frame with opposed and spaced sides;

a picture frame freely levitating and rotating within the spaced sides of the outer fixed frame;

a first permanent magnet mounted on the top part of the picture frame and a second permanent magnet mounted at the bottom part of the picture frame such that the centers of the two mounted permanent magnet coincide with a vertical axis through the center of gravity of the picture frame;

a third permanent magnet mounted at the bottom part of the fixed outer frame such that the center of the third permanent magnet coincides with said vertical axis and with the polarity of the third permanent magnet being such that a downward pulling force is exerted on the picture frame;

an electro-magnet mounted on the top part of the outer fixed frame such that its center also coincides with said vertical axis with the magnetic polarity of the electro-magnet such that an upward lifting force is exerted on the picture frame;

a levitation position sensor mounted in the bottom part of the outer fixed frame with its center coinciding with said vertical axis and a permanent magnet mounted at the bottom of the picture frame with the center of the bottom mounted permanent magnet coinciding with said vertical axis to trigger the levitation position sensor; and a permanent magnet mounted on a side of the picture frame; and an electro-magnet and a magnetic sensor-switch mounted on the said outer fixed frame at a position opposing the side mounted permanent magnet.

4. The display device described in claim 3 further consisting of a servo-control and feedback circuit mounted on the outer fixed frame to adjust the direction and rate of rotation to between 5 second per revolution and 30 second per revolution.

5. The display device described in claim 3 wherein there are a plurality of permanent magnets mounted on the side of the picture frame opposing the electro-magnet mounted on the side of the outer fixed frame.

6. The display device described in claim 3 wherein a small object is displayed in the picture frame.

* * * * *